US008347544B1

(12) United States Patent
Swan

(10) Patent No.: US 8,347,544 B1
(45) **Date of Patent: *Jan. 8, 2013**

(54) DAMPENING DEVICE FOR ABSORBING SHOCK WAVES AND DISSIPATING HARMONIC VIBRATION GENERATED BY A FIREARM

(76) Inventor: Richard E. Swan, E. Bridgewater, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/494,041

(22) Filed: Jun. 12, 2012

Related U.S. Application Data

(63) Continuation of application No. 13/008,911, filed on Jan. 19, 2011, now Pat. No. 8,205,375.

(60) Provisional application No. 61/296,233, filed on Jan. 19, 2010.

(51) Int. Cl.
*F41G 1/38* (2006.01)
*F41C 27/00* (2006.01)

(52) U.S. Cl. ..... 42/124; 42/90

(58) Field of Classification Search ..... 42/90, 124, 42/127; 89/42.01, 44.01, 44.02
See application file for complete search history.

(56) References Cited

U.S. PATENT DOCUMENTS

| | | | |
|---|---|---|---|
| 2,450,466 | A | 10/1948 | Carlson |
| 2,510,289 | A | 6/1950 | Livermore |
| 2,635,341 | A | 4/1953 | Kruzell |
| 2,710,453 | A | 6/1955 | Beverly |
| 4,027,414 | A | 6/1977 | Felix |
| 4,845,871 | A | 7/1989 | Swan |
| 5,276,988 | A | 1/1994 | Swan |
| 5,396,725 | A | 3/1995 | Talbot |
| 6,678,988 | B1 | 1/2004 | Poff, Jr. |
| 7,013,593 | B2 | 3/2006 | Pettersson et al. |
| 7,493,721 | B2 | 2/2009 | Swan |
| 7,594,352 | B2 | 9/2009 | Holmberg |
| 8,205,375 | B1 * | 6/2012 | Swan ..... 42/124 |
| 2004/0016169 | A1 | 1/2004 | Poff, Jr. |
| 2006/0207156 | A1 | 9/2006 | Larue |
| 2008/0178511 | A1 | 7/2008 | Storch et al. |
| 2009/0205240 | A1 | 8/2009 | Dextraze |
| 2009/0288328 | A1 | 11/2009 | Kiser |
| 2010/0011649 | A1 | 1/2010 | Holmberg |

FOREIGN PATENT DOCUMENTS

| | | |
|---|---|---|
| BE | 1014676 A7 | 3/2004 |
| DE | 2137659 A1 | 2/1973 |
| FR | 2588370 A1 | 4/1987 |

OTHER PUBLICATIONS

"Airgun Scope Mounts"—ExpertAdvice—URL:http://www.airgunshooting.co.uk/expertadvice-details.aspx?id=96.

* cited by examiner

*Primary Examiner* — Bret Hayes
(74) *Attorney, Agent, or Firm* — Barlow, Josephs & Holmes, Ltd.

(57) ABSTRACT

A dampening device for absorbing shock waves and dissipating harmonic vibration generated by a firearm includes a body, a clamping assembly configured to releasably clamp the body to the firearm, and a dampening structure disposed within a cavity formed in the body. The cavity has opposing fixed end walls, and the dampening structure is captivated between the opposing fixed end walls of the cavity.

16 Claims, 9 Drawing Sheets

DAMPENING DEVICE FOR ABSORBING SHOCK WAVES AND DISSIPATING HARMONIC VIBRATION GENERATED BY A FIREARM

CROSS-REFERENCE TO RELATED APPLICATIONS

This application is a continuation of co-pending U.S. application Ser. No. 13/008,911, filed Jan. 19, 2011.

U.S. application Ser. No. 13/008,911 is a non-provisional filing of, and claims the benefit of, U.S. Application No. 61/296,233, filed Jan. 19, 2010.

BACKGROUND OF THE INVENTION

The present invention relates generally to modular integrated accessory mounting assemblies for combat weapons. More specifically, the present invention relates to a unique dampening structure incorporated into an accessory mount in a manner that dampens shock waves and the resulting harmonic vibration caused by operation of the firearm.

As the field of combat and commercial weaponry expands, numerous add-on enhancements have become available for attachment to standard firearms, thereby significantly upgrading the capability of the firearm. Of particular interest in the area of combat weapons are the well-known M16/M4 weapon systems (M16 and M4 are trademarks of Colt Defense, Inc.), the FNH™ SCAR™ weapon system (FN and SCAR are trademarks of FN Herstal, S.A., and the Barrett™ family of high caliber sniper weapons (Barrett is a trademark of Barrett Firearms Mfg., Inc.). However, the concepts of the present invention are equally applicable to all firearms, weapon systems, and add-on enhancements. In particular, the concepts of the present invention are most applicable to larger caliber service weapons such as the 50 caliber Barrett™ M82A1 rifle. For purposes of illustration only, we refer to FIG. 1, which shows an image of the M82A1 rifle generally indicated at 10. The weapon 10 generally includes a receiver 12, stock 14, and barrel 16.

Most modern combat weapons further include a mil-std 1913 dovetail rail 18 extending along the top of the receiver. This integrated receiver rail provides a convenient mounting point for many types of enhancement devices such as scopes 20 and/or other sighting devices. The increasing development and refinement of laser sights, infrared lighting, visible lighting, night vision, and specialized scopes and magnifiers, and other accessories continues to drive the need for versatile and reliable integration systems that can support this important equipment and yet stand the test of rugged military use and abuse.

One of the issues of mounting sensitive electro-optic components on a weapon is that shock waves and harmonic vibration resulting from operation of the weapon are transmitted through the weapon and mounts into the mounted component. Shock waves and the resultant harmonic vibrations that travel through the mechanical structures of the weapon will fatigue, damage or destroy almost any electro-optical device over time. While some of the sighting devices that are employed with a firearm may be able to endure the shocks, many more are damaged and ultimately fail as a result of the transferred shock waves and harmonic vibration. All branches of the military are reporting increased instances of field failure of these expensive, highly sensitive optic components on all types of weapons. However, failures are particularly distinguished on the more powerful, higher caliber weapons.

Before proceeding, we will need to distinguish "recoil" from "shock waves" and "vibration". Simply put, "recoil" is the backward push of a firearm. According to Newton's third law of motion, for every action there is an equal and opposite reaction. Recoil is thus an equal but opposite reaction of the weapon to the forward momentum of the projectile exiting the barrel. The expanding gas of the burning powder causes recoil. It forces the bullet out of the case and down the barrel and exerts an equal force back against the rear of the chamber. The force is the same in both directions.

Modern autoloading (automatic or semi-automatic) weapons have the same measured recoil as bolt action weapons, but the "kick" felt by the shooter is less for some types of actions. The spring systems that are used to cycle the weapon and load the next cartridge operate to distribute some of the recoil thrust that would be felt by the shooter.

In addition to recoil, every weapon also experiences higher frequency shock waves and harmonic vibration caused by slamming of the moving parts of weapon against each other. Webster's dictionary defines a "wave" as a disturbance that transfers energy progressively from point to point in a medium and may take the form of an elastic deformation of the medium. For purposes of this invention, the most important part of this definition is that a wave is a "disturbance" which travels through a medium. The medium through which the wave travels may experience local oscillation as the wave passes. Vibration refers to mechanical oscillations about an equilibrium point. Vibration is occasionally desirable, such as the motion of a tuning fork. More often, vibration is undesirable, wasting energy and creating unwanted disturbances. Free vibration occurs when a mechanical system is set off with an initial input (wave) and then allowed to vibrate freely. The mechanical system will then vibrate at its natural frequency and gradually damp down to zero. The simplest analogy is the ringing vibration of a piece of metal when struck by a hammer.

Referring now to FIG. 2, a set of 3 graphs depicts the magnitude of shock waves experienced by an M82A1 (50 caliber) sniper rifle firing a single round. Each graph represents a measurement along a liner axis with the x-axis extending lengthwise along the weapon, the y-axis extending transversely across the weapon, and the z-axis extending vertically through the weapon. Each graph is set out with acceleration on the y-axis and time and on the x-axis. There are three distinct events that generate shock waves in this semi-automatic weapon. First, the discharge of the cartridge creates an initial shock wave (event 1) 22. Second, the gas blow-back slams the bolt backward against the buffer spring, bottoming out against the bottom of the spring cavity (event 2) 24. Finally, the buffer spring sends the bolt forwardly slamming it into the rear end of the barrel to seat another round in the chamber (event 3) 26.

While existing buffer spring systems are intended to capture the energy of the rearward thrust of the bolt, they are not designed to dampen higher frequency shock waves and harmonic vibrations, which are distinctly different from recoil.

The prior art uncovered by the Applicant seeks to address the effects of recoil on scope mounts. Typically, these systems introduce a spring element that sits between the mount body and the rings and allows cushioned movement of the rings (and scope) longitudinally relative to the mount body.

U.S. Pat. No. 2,510,289 to Livermore discloses such a mounting system wherein a spring tube is positioned between the bases of the rings and the mount body to provide a cushioned buffer against recoil.

U.S. Pat. No. 2,710,453 to Beverly discloses another such mounting system where a compression spring is seated between a fixed pin and a movable pin to both allow the scope to be swung to one side and to be removed from the base.

U.S. Pat. No. 6,678,988 to Poff discloses yet another such mount where a lower rail portion is fixedly mounted on the weapon and an upper rail portion slidably moves relative to the lower rail portion, A scope is mounted on the upper rail. A pair of compression springs cushion forward and rearward movement of the upper rail relative to the lower rail caused by recoil. French patent FR2588370 is very similar to Poff in many respects.

U.S. Pat. No. 7,013,593 to Pettersson is directed to a holder device including springs that reduce axial recoil motion.

The Applicant's own U.S. Pat. No. 4,845,871 is cited for its disclosure of a pair of Belleville springs that are situated between a cam foot and a base to hold the mount in place. These springs are not intended to absorb recoil shock. However, they do provide a softer, cushioned interface between the hard mount and attachment rail of the weapon.

While each of the devices of the prior art is generally effective for its intended purpose, i.e. absorbing recoil thrust, none are directed at the unique problem of absorbing high frequency shock waves and harmonic vibration, which can destroy sensitive electro-optic devices.

SUMMARY OF THE INVENTION

The present invention seeks to provide a unique dampening structure incorporated into an accessory mount in a manner that dampens shock waves and the resulting harmonic vibration cause by operation of the firearm.

The dampening structure can be used as a stand-alone device for independently absorbing and dissipating shock waves and harmonic vibration generated by the weapon, i.e. separate and apart from a mount for an accessory, but is more preferably integrated into the body of a mount used to attach a particular accessory to a weapon. In this manner the dampening structure can be tuned and adapted for the best performance with respect to the mounted accessory.

A mounting assembly for attaching an accessory to a dovetail rail interface comprises a body having a lower portion and an upper portion. The lower portion is configured and arranged to engage a first side of the dovetail rail while the upper portion configured to receive and retain an accessory, such as a scope mount. In this regard, in one of the preferred embodiments, the upper portion includes a pair of rings that clamp around the tube of a telescopic sight. A dampening structure is incorporated within the body of the mount where it is configured to dampen shock waves and harmonic vibration transferred into the body from operation of the firearm. More specifically, the dampening structure comprises a spring, which is captured within a bore or channel extending longitudinally within the body. More specifically, the spring is a coil spring, although other types of springs are contemplated. The spring is at least partially compressed and the compression can be adjusted by means of a threaded captivating nut received in the open end of the bore.

Extending outwardly from the side surface of the body is a boss formation including an opening therein which serves as a platform for a clamping assembly. The clamping assembly extends through the opening in the boss and is configured to releasably engage a second side of the dovetail rail. More specifically, the clamping assembly includes a foot portion positioned adjacent a bottom surface of the boss formation. The foot portion includes a cam surface.

To provide movement of the foot, an actuator arm extends outwardly from the foot portion. A shaft extends upwardly from the foot portion through the opening in the boss formation where a spring is received around the shaft adjacent the top surface of the boss formation. A retention nut is threadedly received on a terminal end of the shaft such that the spring is captured between a bottom surface of the retention nut and a top surface of the boss formation.

To insure that the retention nut stays in the position set by the user, a locking pin is threadedly received through a bore in the actuator arm. The locking pin is configured and arranged to allow a user to positively lock the position of the retention nut on the threaded shaft.

In operation, movement of the clamping assembly to releasably engage the dovetail rail causes the foot portion to clamp against the second side of the dovetail rail.

Accordingly, it is a core object of the invention to provide a dampening structure that can be mounted onto a weapon for the purpose of absorbing shock waves and harmonic vibration generated by operation of the weapon.

It is a further object of the invention to provide a mounting assembly for mounting accessories to a weapon wherein the mount includes an integrated dampening structure for absorbing shock waves and harmonic vibration generated by operation of the weapon.

It is yet another object of the invention to provide such a mounting assembly where the dampening structure is a coil spring extending longitudinally, parallel to the long axis of the weapon.

These, together with other objects of the invention, along with various features of novelty that characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWING FIGURES

The invention will now be described further by way of example with reference to the following examples and figures, which are intended to be illustrative only and in no way limiting upon the scope of the invention.

DETAILED DESCRIPTION OF THE PREFERRED EMBODIMENT

Figure 1:
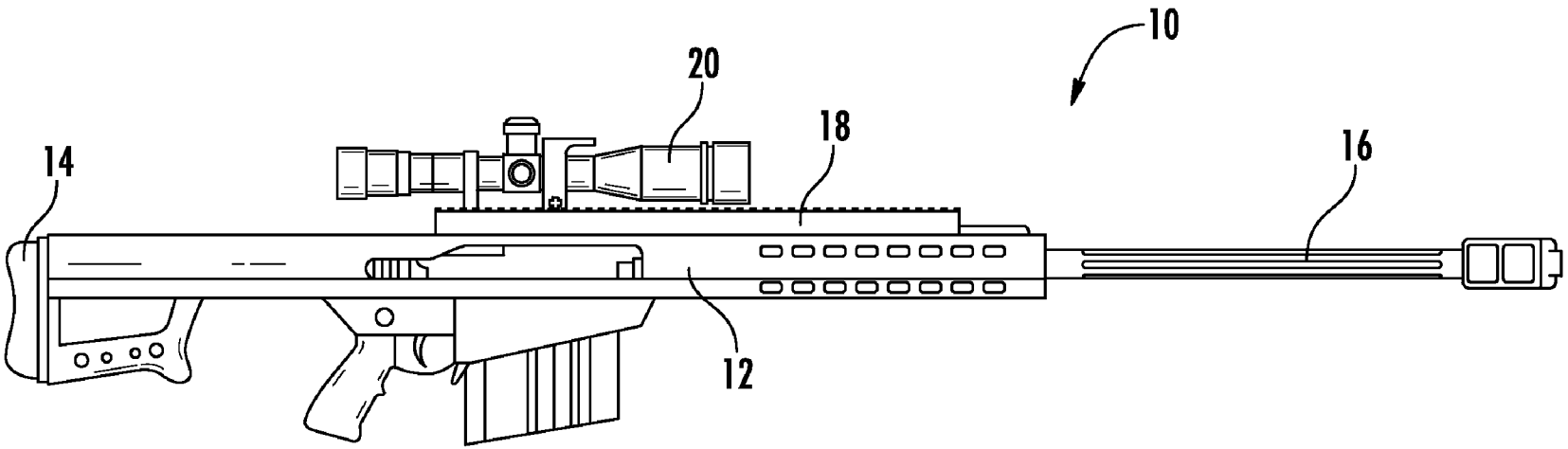
FIG. 1 shows a plan view of an M82A1 sniper rifle.
Figure 2:
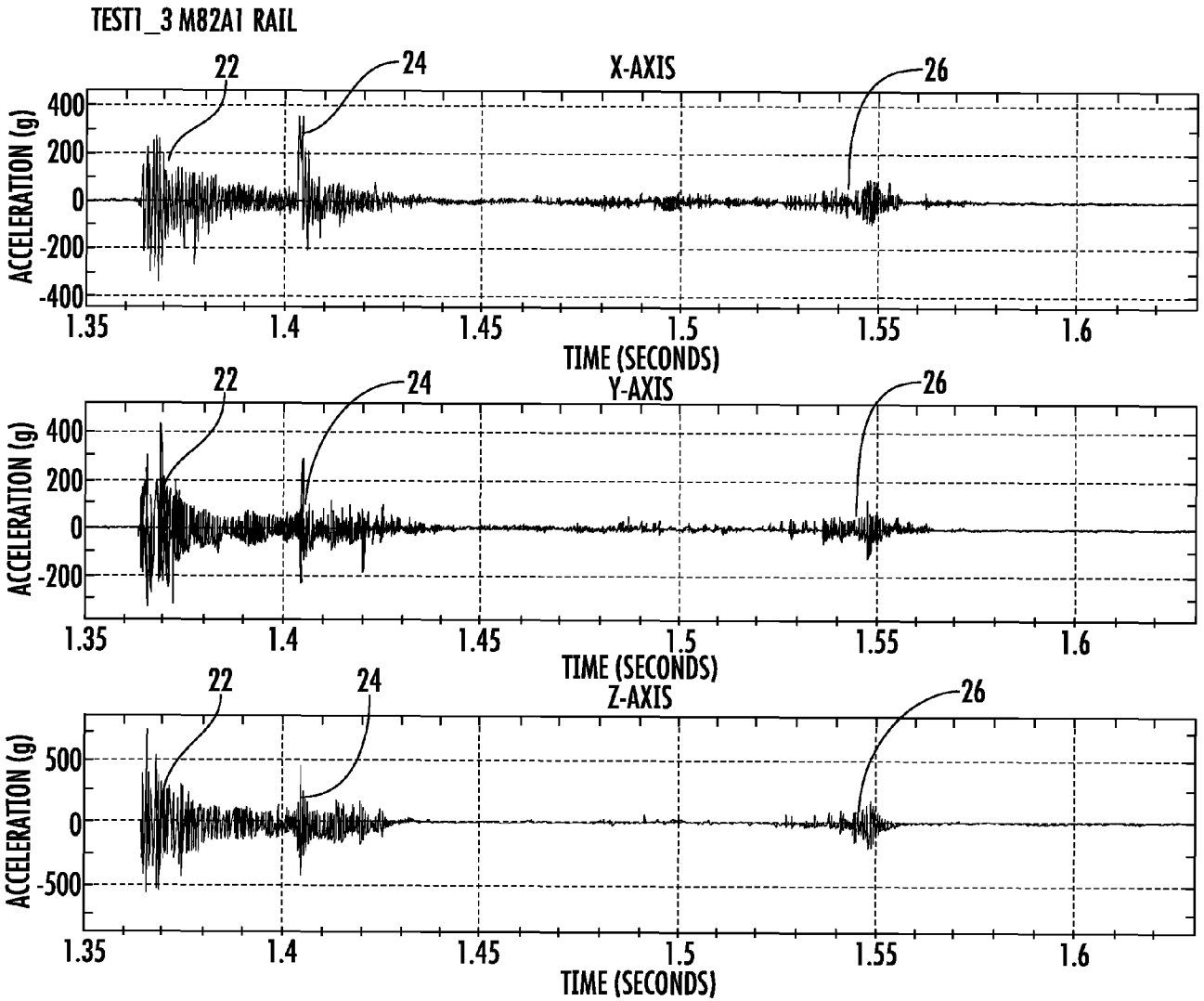
FIG. 2 shows a set of graphs depicting 3 separate shock wave events generated by the firing of a single round.
Figure 3:
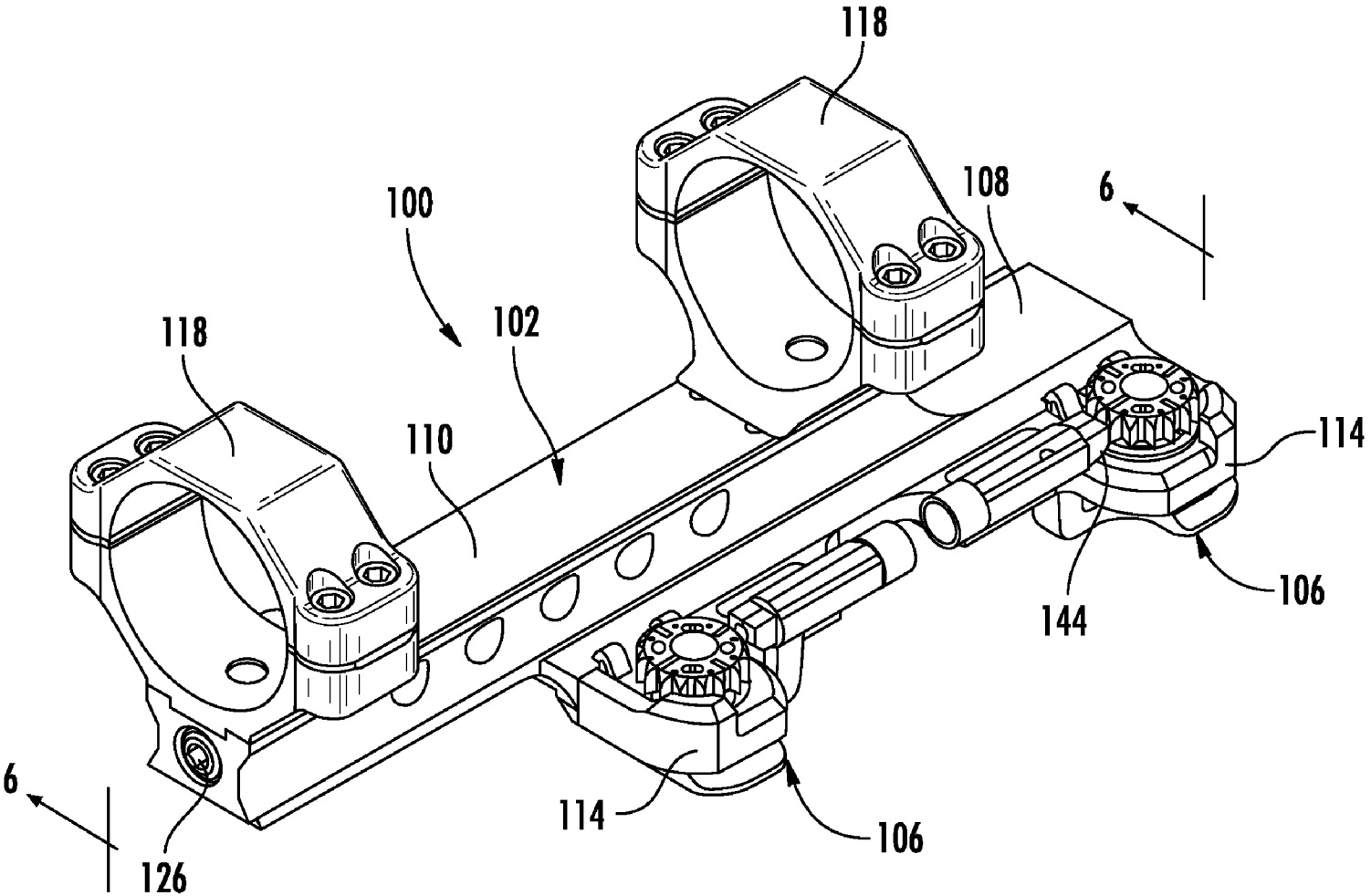
FIG. 3 shows a perspective view of a mount constructed in accordance with the teachings of the present invention.
Figure 4:
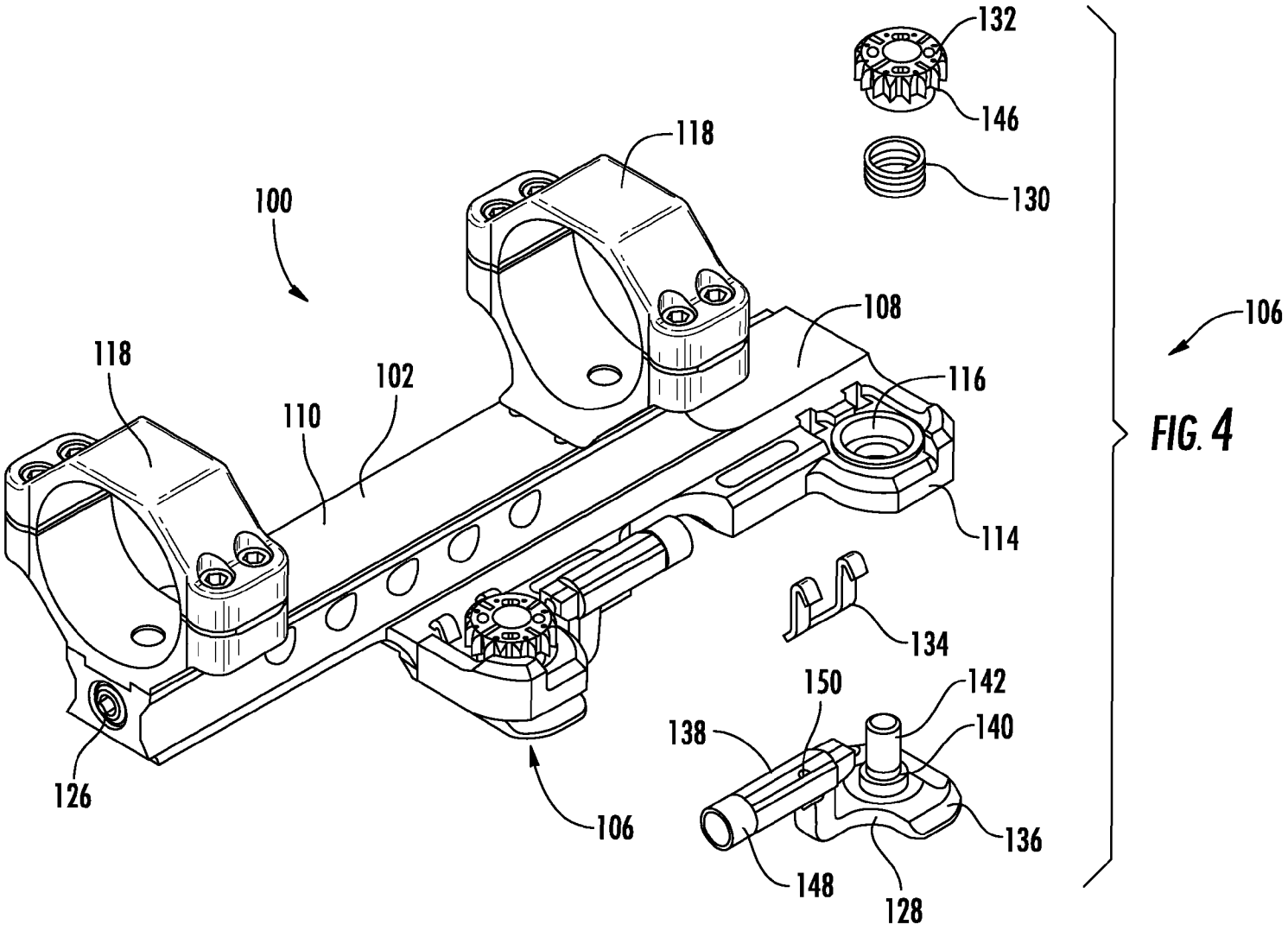
FIG. 4 is another view thereof showing the clamping assembly partially exploded.
Figure 5:
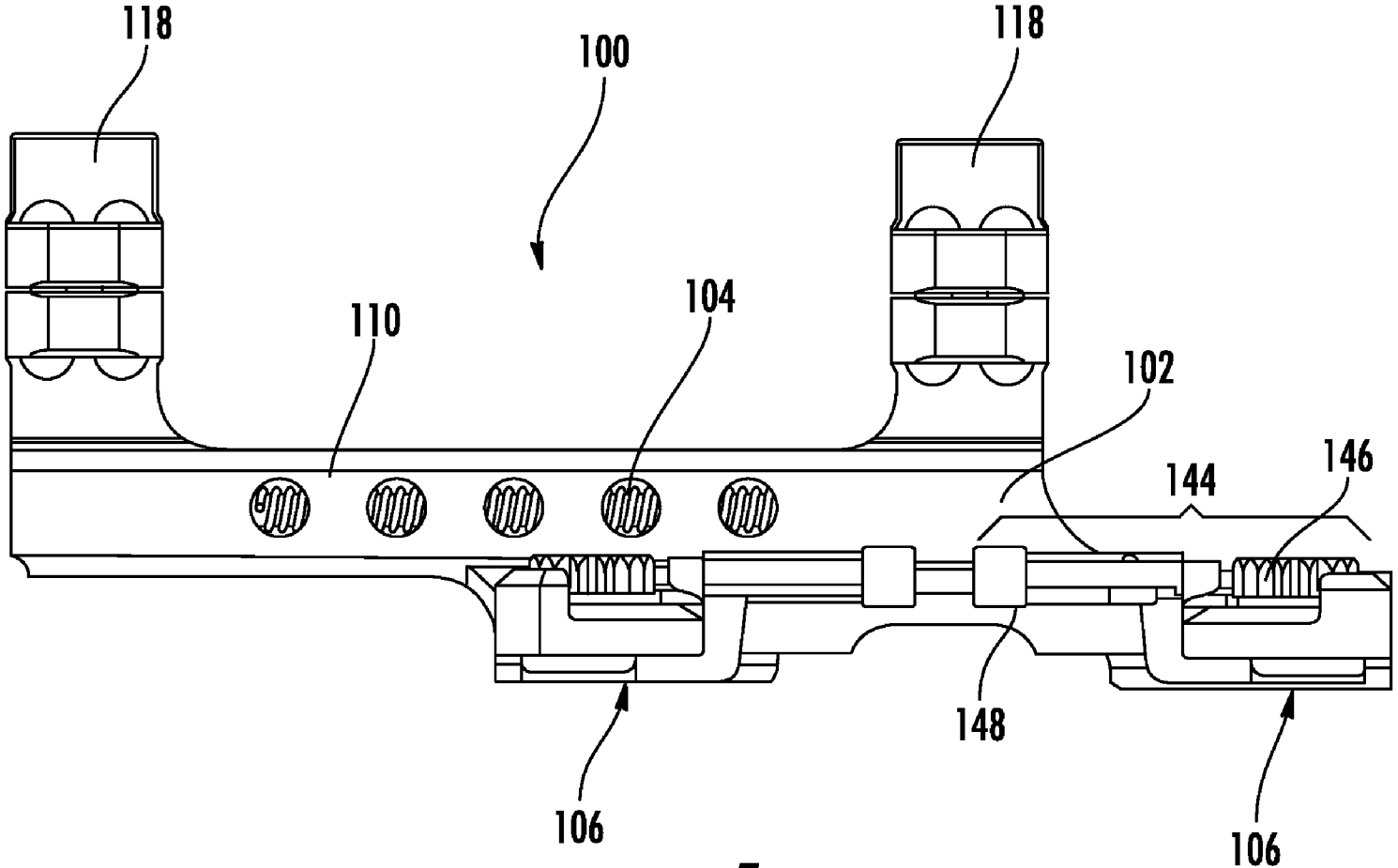
FIG. 5 is a right side view thereof.
Figure 6:
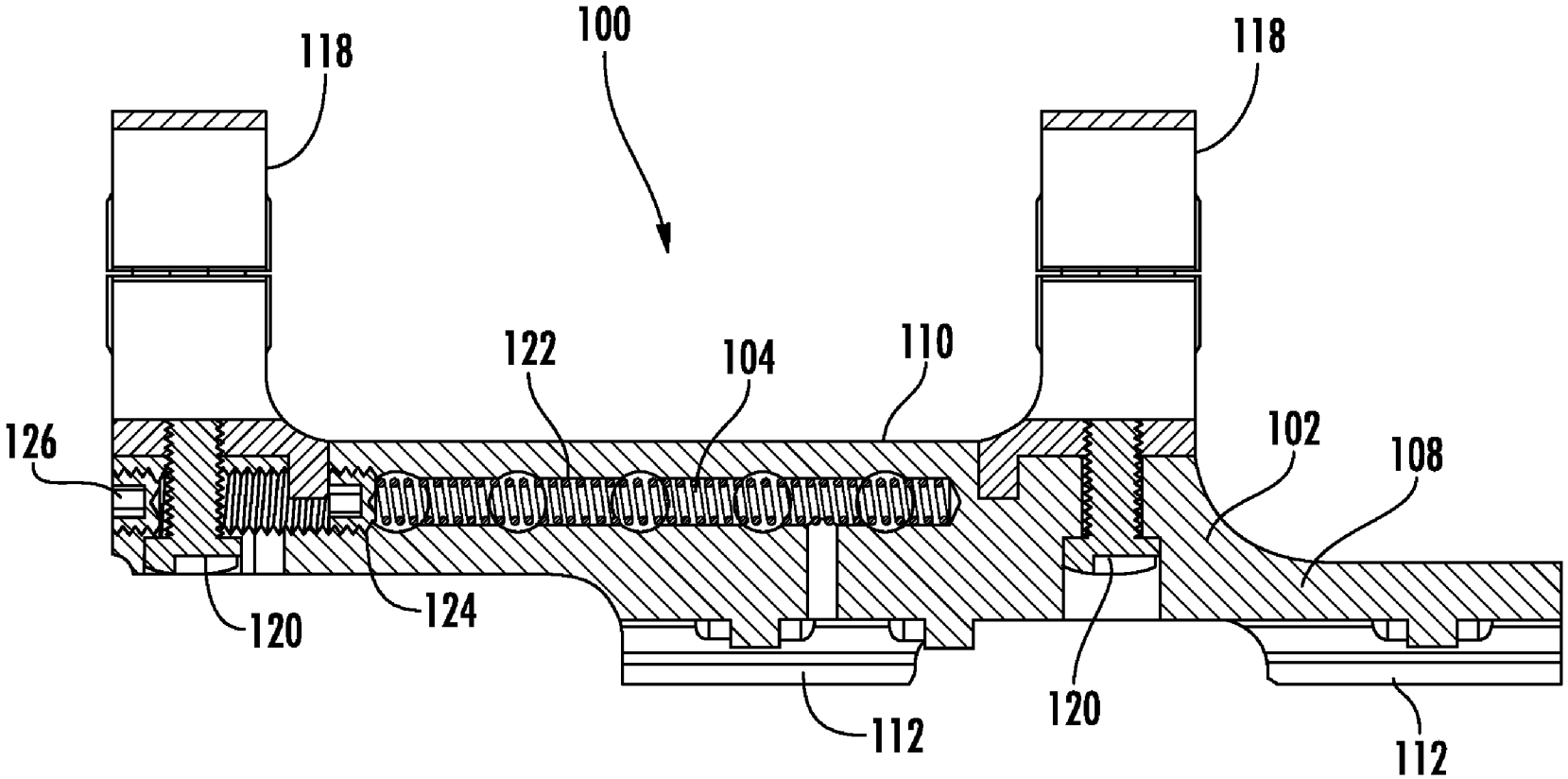
FIG. 6 is a cross-sectional view thereof taken along line 6-6 of FIG. 3.
Figure 7:
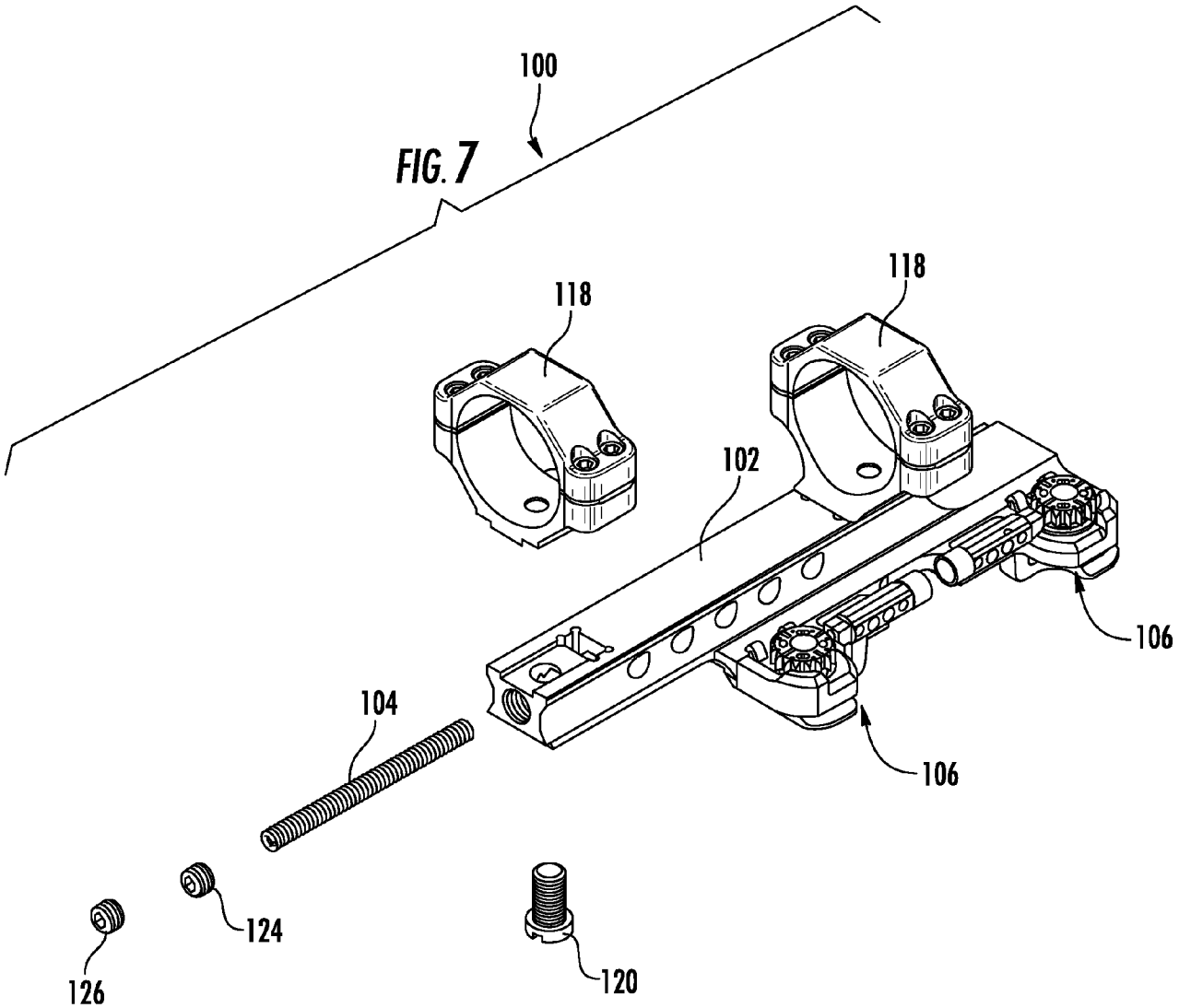
FIG. 7 is another perspective view thereof showing the dampening structure exploded.

Now referring to the drawings, a mounting assembly constructed in accordance with the teachings of the present invention is shown and generally illustrated at 100 in FIGS. 3-7.

The mounting assembly 100 generally includes a body 102, a dampening structure 104, and a clamping assembly 106. It is noted that the illustrated mount includes a pair of clamping assemblies 106. However, for purposes of this description we will refer to a single clamping assembly 106.

The body 102 includes a lower portion 108 that is configured to engage the dovetail rail 18 found on most modern combat weapons and an upper portion 110 that can take on a variety of configurations depending on the accessory that is to be mounted thereon. The lower portion 108 of the body has a pair of first engagement members 112 extending downwardly along one side thereof for engaging one side of the dovetail rail 18. Opposite the first engagement members 112, a boss formation 114 is provided adjacent the side of the body 102. An annular bushing 116 is installed into the opening of the boss 114.

Referring to FIGS. 3-6, the upper portion of the body is provided at each end with rings 118 for receiving and holding a telescopic sight (not shown). The rings 118 are held in place by screws 120 received through the body 102 but are otherwise conventional within the art and no further explanation is believed to be needed.

In accordance with the teachings of the present invention and as can best be seen in the side and cross sectional views (FIGS. 5 and 6), the upper portion 110 of the body 102 includes a longitudinal channel 122 or borehole formed therein. Preferably, the borehole 122 extends longitudinally within the body 102 parallel to the longitudinal extent of the firearm on which it will be mounted. A dampening structure 14, preferably a coil spring, is received within the borehole 122 and is seated against the bottom wall thereof. A captivating plug 124 is then received into the open end of the channel/borehole to retain the spring 14 therein. Preferably, the captivating plug 124 is threadably received within the open end of the channel or bore 122. The captivating plug 124 further preferably at least partially compresses the spring 14 within the channel or bore 122. A second plug 126 is received is received in the open end of the bore to close off the end of the bore 122.

The spring 104 positioned within the main body 102 acts as a dampener to absorb shock waves and harmonic vibration generated by the firearm and reduces the transfer of those shocks to the accessory retained on the mount 100.

While a coil spring 104 is illustrated herein as the preferred embodiment, the disclosure should not be considered to be limiting to this embodiment. Depending on the type of weapon and the measured shock wave and harmonic vibration as generated by the particular weapon, different types and variations of spring dampeners 104 may be utilized, including but not limited to accordion springs, belleville-type springs, and leaf springs, as well as resilient or elastic materials such as silicone, cork, and polymeric foams. Likewise, while the orientation of the spring is indicated at being longitudinal in the preferred embodiment, the orientation should not be limited to this configuration. The dampening structure 104 may be oriented in whatever direction the largest shock wave is measured. This could potentially be horizontal or vertical or at an angle to the mount. In addition, the disclosure should not be considered to be limited to the use of a single dampening structure, nor should it be limited to the use of a single dampening structure extending in a single direction. Compound dampening may require the use of several different dampening structures extending in different directions as the situation may require. Experimentation and testing is required to determine the direction and magnitude of the shock waves and harmonic vibration of a particular weapon.

The clamping assembly 106 generally includes a foot portion 128 that is positioned adjacent the bottom surface of the boss formation 114, a spring 130, a retention nut 132 and a buffer pad 134. The foot portion 128 includes an angulated cam surface 136 that extends around the side surfaces of the foot portion 128 as in the prior art devices. The foot portion 128 is configured as a dual sided foot so that only one foot and arm need be provided for both left and right hand mounting assemblies. An actuator arm 138 extends outwardly directly from the foot portion below the boss formation 114 and allows the user to rotate the foot portion 128 between engaged and disengaged positions. A shaft 140 is affixed to and extends upwardly from the foot portion 128 through the bushing 116 and terminates in a threaded end 142.

Spring 130 in the form of a coil spring or spring washer is received around the shaft 140 and is seated on the bottom wall of the bushing 116.

The retention nut 132 having a threaded bore is threadedly received on the threaded terminal end 142 of the shaft 140 such that the spring 130 is captured between the bottom surface of the retention nut 132 and the upper surface of the bottom wall of the bushing 116. The spring 130 is compressed as the retention nut 132 is tightened thereby providing for adjustment of the initial spring tension of the clamping assembly 106.

It is noted that this spring arrangement 130 contained within the clamping assembly 106 provides at least some additional dampening in the vertical axis, although the size and significant compression of the spring limits the amount of dampening this spring can provide.

In order to protect the soft aluminum rails 18 of the weapon 10, the steel buffer pad 134 is pivotably received adjacent the cam surface 136 of the foot 128.

To insure that the retention nut 132 remains in a position as set by the user, the clamping assembly 106 further comprises a locking mechanism 144 for positively locking the position of the retention nut 132 on the threaded shaft 140. The locking mechanism 144 preferably comprises at least one locking formation (detent) 146 on the outer edge surface of the retention nut 132 and a threaded locking pin 148. As shown in this embodiment, the detents 146 extend all the way around the outer surface of the retention nut 132 to provide a wide range of adjustment. The locking pin 148 is received within a bore formed in the handle portion of the actuator arm 138. Threads on the proximal end of the locking pin 148 adjacent a head portion of the locking pin engage complimentary threads within the bore in the actuator arm 138. While the locking pin 148 can be displaced inwardly and outwardly relative to the actuator arm 138, the locking pin 148 is further held within the bore by a roll pin 150 extending across the bore and across a shoulder region slot formed on the locking pin. The shoulder region provides a sufficient amount of travel for retraction and engagement of the pin but prevents it from falling out.

Since the spring 130 is trapped between the retention nut 132 and the bushing 116, tightening of the retention nut 132 causes compression of the spring 130, shortens the range of the vertical travel of the foot portion 128 relative to the bottom surface of the boss 114 and increases the spring clamping force. Accordingly, when the actuator arm 138 rotates the foot portion 128 into engagement with buffer pad 134 and in turn the rail 18, additional spring pressure is exerted on dovetail rail. Similarly, as the retention nut 132 is loosened, the compression of the spring 130 is reduced, the range of vertical travel of the foot portion 128 is increased, and the clamping force is reduced. In order to tighten or loosen the retention nut 132, the locking pin 148 is unthreaded relative to the actuator arm 138 until the distal end of the locking pin 148 is clear of the detents 145 in the retention nut 132 thereby allowing rotation of the retention nut 132 relative to the clamping assembly 106. After the retention nut 132 is adjusted and the desired spring tension is set, the locking pin 148 is threaded back into the bore such that the distal end of the locking pin engages one of the detents 146 on the retention nut 132 preventing rotation of the retention nut 132 relative to the clamping assembly 106.

It can further be appreciated that the head at the proximal end of the locking pin 148 includes a texturing or knurling thereon as well as an increased diameter to facilitate turning of the locking pin by hand.

Figure 8:
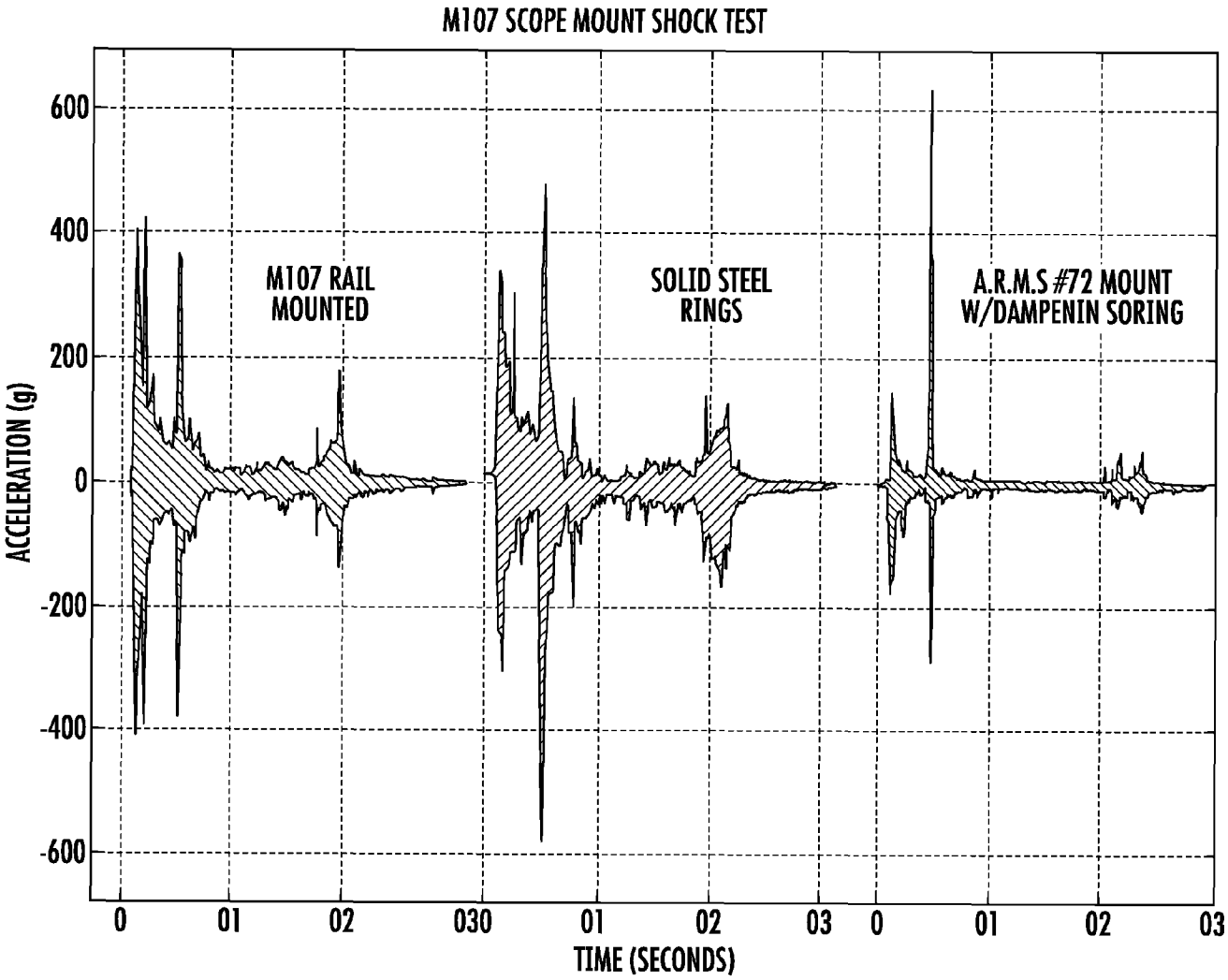
FIG. 8 is a perspective view of a dampening mount constructed in accordance with the teachings of the present invention.

Referring now to FIG. 8, a single graph shows the side-by-side results obtained from accelerometer sensors mounted on three different configurations of an M107 sniper rifle. The results illustrated show shock wave and harmonic vibration measured along the x-axis (the longitudinal extent of the weapon parallel to the barrel). The results to the far left (M107 Rail Mounted) are measurements taken directly from sensor mounted directly on the rail interface of the weapon. The results in the middle (Solid Steel Rings) are measurements taken from sensors mounted on a set of steel rings mounted on the rail interface of the weapon. The left and middle results show that much of the shock and vibration experienced by the weapon is directly transferred into the rings, and thus into the telescopic sight clamped in the rings. The results to the far right (A.R.M.S. #72 Mount w/Dampening Spring) are measurements taken from sensors mounted on the preferred embodiment of the invention as illustrated herein (FIGS. 3-7).

The goal of the testing was to capture and characterize the shock/harmonic events and evaluate the benefits of the dampening structure within the mount of the invention versus old fashioned hard mounting rings. The right hand graph clearly demonstrates that the present invention offers a drastic reduction (>2×) in initial shock impact to an electro optical device, as well as a reduced overall harmonic vibration energy when compared to traditional sold hard mount rings.

Figure 9:
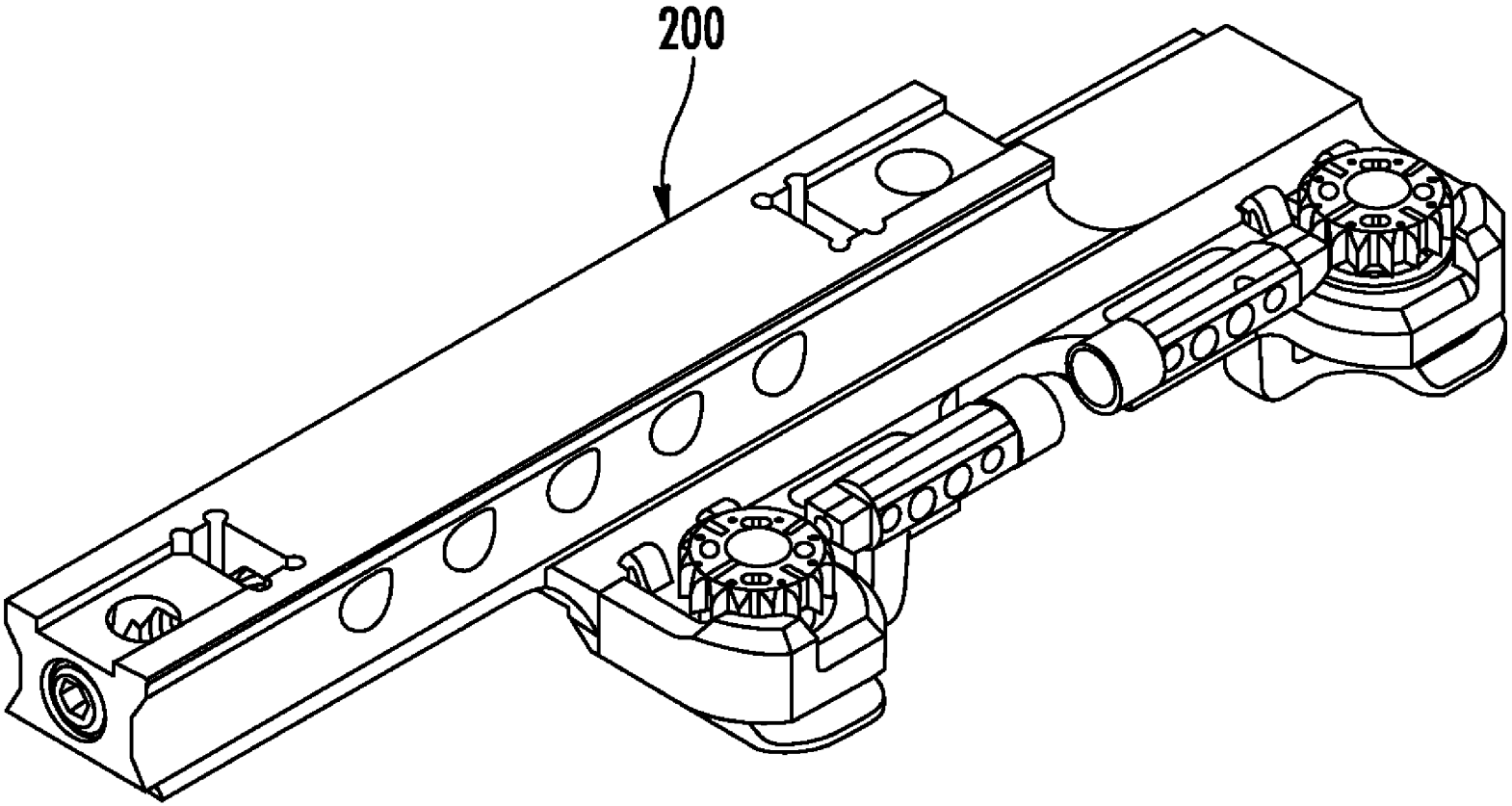
FIG. 9 is a graph showing experimental test data.

Turning to FIG. 9 there is shown an alternative embodiment 200 which can be used as a stand-alone dampening device independent of any particular accessory. The dampening device 200 can be mounted on any weapon as an ancillary device for the purpose of absorbing shock waves and harmonic vibration and protecting another accessory mounted onto the weapon using a different mounting system. For example, if a scope is mounted onto a weapon using conventional rings, the present dampening device 200 could be used in conjunction with the ring mounting system to provide dampening of the shock waves and harmonic vibration within the weapon to reduce the level of shock and vibration to be transferred into the existing ring mounts. In this regard, the dampening device 200 is which is virtually identical to the first embodiment 100, except that the rings have been removed. Such a dampening device 200 could be mounted on a rail interface adjacent to the sighting device or at another location. Certain locations may be found to have better performance than others as determined by experimental data and testing.

Accordingly, it can be seen that the present invention provides a unique and novel modular accessory mount that fills a critical need for soldiers in the field by ensuring positive and reliable operation. For these reasons, the instant invention is believed to represent a significant advancement in the art, which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A dampening device for absorbing shock waves and dissipating harmonic vibration generated by a firearm, said dampening device comprising:

a body having a lower portion configured to engage a dovetail rail interface on a firearm;

a clamping assembly configured to releasably clamp said body to said dovetail rail interface; and a dampening structure within a cavity formed in said body, said cavity having opposing fixed end walls, said dampening structure being captivated between said opposing fixed end walls of said cavity, said dampening structure being configured and arranged within said body to dampen shock waves and dissipate harmonic vibration generated by said firearm and transferred into said body.

2. The dampening device of claim 1 wherein said dampening structure extends longitudinally within said body.

3. The dampening device of claim 1 wherein said dampening structure comprises a spring.

4. The dampening device of claim 2 wherein said dampening structure comprises a spring.

5. A dampening device for absorbing shock waves and harmonic vibration in a firearm, said dampening device comprising:

a body having a lower portion configured to engage a dovetail rail interface on a firearm, said body including a longitudinally extending bore hole;

a clamping assembly configured to releasably clamp said body to said dovetail rail interface; and a dampening structure within said body, said dampening structure being configured and arranged within said body to dampen shock waves and harmonic vibration generated by said firearm and transferred into said body, said dampening structure comprising a spring received within said bore hole, said spring being captivated by an end wall of said bore hole and a captivating plug received in an open end of said bore hole, said spring being at least partially compressed.

6. The dampening device of claim 5 wherein said captivating plug is threadably received within said open end of said bore hole.

7. A mounting assembly for attaching an accessory to a dovetail rail interface, said mounting assembly comprising:

a body having a lower portion and an upper portion, said lower portion configured to engage a dovetail rail interface, said upper portion configured to receive and retain an accessory;

a dampening structure within a cavity formed in said body, said cavity having opposing fixed end walls, said dampening structure being captivated between said opposing fixed end walls of said cavity, said dampening structure being configured and arranged within said body to dampen shock waves and dissipate harmonic vibration transferred into said body; and a clamping assembly configured to releasably clamp said body to said dovetail rail interface.

8. The mounting assembly of claim 7 wherein said dampening structure extends longitudinally within said body.

9. The mounting assembly of claim 7 wherein said dampening structure comprises a spring.

10. The mounting assembly of claim 8 wherein said dampening structure comprises a spring.

11. A mounting assembly for attaching an accessory to a dovetail rail interface, said mounting assembly comprising:

a body having a lower portion and an upper portion, said lower portion configured to engage a dovetail rail interface, said upper portion configured to receive and retain an accessory, said body including a longitudinally extending bore hole;

a dampening structure within said body, said dampening structure being configured and arranged within said body to dampen shock waves and harmonic vibration transferred into said body, said dampening structure comprising a spring received within said bore hole, said spring being captivated by an end wall of said bore hole and a captivating plug received in an open end of said bore hole, said spring being at least partially compressed; and a clamping assembly configured to releasably clamp said body to said dovetail rail interface.

12. The mounting assembly of claim 11 wherein said captivating plug is threadably received within said open end of said bore hole.

13. A dampening device for absorbing shock waves and dissipating harmonic vibration generated by a firearm, said dampening device comprising:

a body;

a clamping assembly configured to releasably clamp said body to said firearm; and a dampening structure within a cavity formed in said body, said cavity having opposing fixed end walls, said dampening structure being captivated between said opposing fixed end walls of said cavity, said dampening structure being configured and arranged within said body to dampen shock waves and dissipate harmonic vibration generated by said firearm and transferred into said body.

14. The dampening device of claim 13 wherein said dampening structure extends longitudinally within said body.

15. The dampening device of claim 13 wherein said dampening structure comprises a spring.

16. The dampening device of claim 14 wherein said dampening structure comprises a spring.

* * * * *